United States Patent [19]

Black

[11] 4,242,822

[45] Jan. 6, 1981

[54] REMOVABLE SIGN POST HOLDING APPARATUS

[76] Inventor: John W. Black, 1940 Papago, Sheridan, Wyo. 82801

[21] Appl. No.: 71,766

[22] Filed: Aug. 31, 1979

[51] Int. Cl.[3] ..... G09F 7/18

[52] U.S. Cl. ..... 40/607; 248/156; 248/530; 248/548

[58] Field of Search ..... 40/607, 608; 248/530, 248/532, 533, 545, 156, 85–88

[56] References Cited

U.S. PATENT DOCUMENTS

| | | | |
|---|---|---|---|
| 2,554,887 | 5/1951 | Tricarico | 248/545 |
| 2,976,000 | 3/1961 | Gunderson | 248/156 |
| 3,809,346 | 5/1974 | Jackson | 248/530 |

FOREIGN PATENT DOCUMENTS

| | | | |
|---|---|---|---|
| 374270 | 6/1932 | United Kingdom | 40/607 |
| 581915 | 10/1946 | United Kingdom | 248/156 |

*Primary Examiner*—John F. Pitrelli

*Attorney, Agent, or Firm*—Arthur L. Urban

[57] ABSTRACT

A removable sign post holding apparatus including a body portion having a post-receiving opening, a plurality of retaining members disposed around the periphery of the body portion, the retaining members extending along the length of the body portion from a point adjacent the post-receiving opening thereof, a plurality of ground-engaging members associated with the retaining members and extending from adjacent the post-receiving opening of the body portion beyond the opposite end of the body portion a significant distance, each of the ground-engaging members having an enlarged portion adjacent the end thereof closest to the post-receiving opening.

7 Claims, 2 Drawing Figures

REMOVABLE SIGN POST HOLDING APPARATUS

Figure 1:
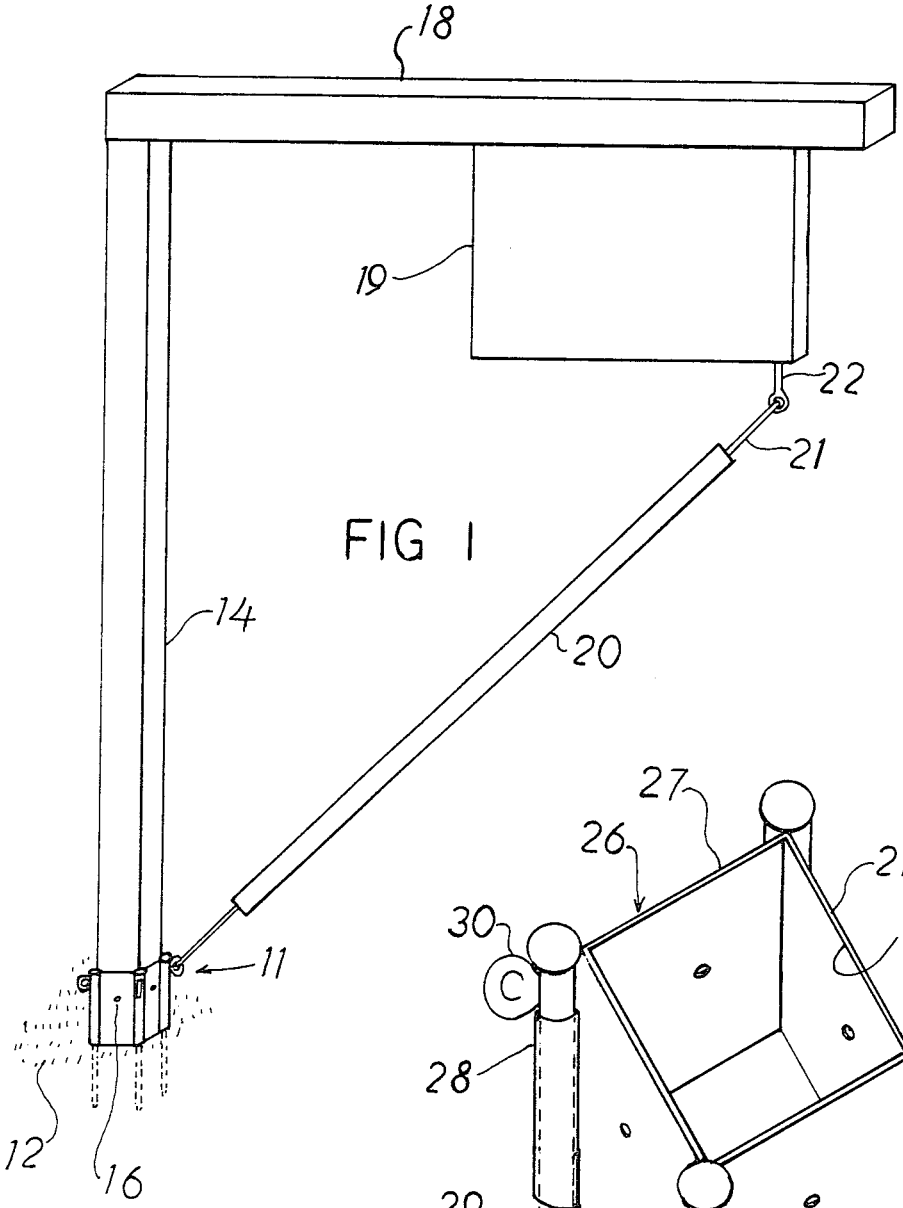

This invention relates to a novel apparatus for holding a sign post in position and more particularly relates to a new apparatus for holding a sign post which permits the post and the apparatus to be removed.

Through the years, signs have been used for a variety of purposes. Signs have been employed for the display of notices, for advertising and the like. The use of signs has become an accepted media for conveying information in modern society.

One of the problems in the use of signs is how to properly position the sign to attract attention of passersby. If a wall, fence or other surface is conveniently located, the sign can be mounted thereon. However, if such a surface is not available, other expedients must be utilized.

Many signs which must be positioned away from other surfaces are mounted on sign posts. The sign posts must be secured in an upright position by one means or another. Usually, this involves burying the end of the post in the ground. To achieve this result, it generally is necessary to dig a hole in which to place the bottom of the post.

Digging a hole often can present problems. For example, the digging is a dirty task which at least may result in the digger's hands becoming soiled and frequently results in the digger's clothes and shoes also becoming soiled. This can be very frustrating as well as require extra effort either in cleaning the body and clothes after the hole has been dug and/or changing into work clothes to dig the hole and then changing back to dress clothes.

Other problems in digging a hole for a sign post are the skill and tools required to dig a proper hole. If care is not exercised in the digging, the post wil not be secured in an upright position but will lean at an undesirable angle. This can occur when the hole is too large and/or the hole is not properly backfilled after placing the post. An oversize hole often results if the shovel is too large for the hole to be dug or if the digger is not careful as he does the digging.

Another undesirable factor to be considered in placing signs by burying the sign post is the physical effort necessary to dig the hole and position the post. Many people, and particularly elderly persons and women, may be incapable of accomplishing this task.

Even when it is possible to dig a hole and position the sign post, the question remains as to what to do with the excess soil remaining after the hole is backfilled. If the sign is permanent, the soil can be discarded. However, if the sign is temporary, removal of the soil usually is not desirable since it must be brought back later to fill the empty hole after the post is removed. On the other hand, if the soil is kept at the sign post, it either is piled around the base of the post or else stored nearby. In either case, the excess soil often is unsightly and detracts from the appearance of the sign.

A further consideration is how to remove the sign and post when it is no longer needed. Generally, the better the post is set initially, the more difficult it is to remove later. Thus, the individual placing the sign is faced with a dilemma. Shall the sign post be placed as securely as possible initially so that the sign will not shift and appear unsightly even though extra effort will be required to remove the post when no longer needed, or alternatively, should the sign post be placed less securely at the start to facilitate easy removal of the post later. While one of the above choices may be acceptable in some situations, in others, neither solution is desirable, with each having serious drawbacks. Thus, the solution selection at best is a compromise that is neither desirable nor satisfying.

In view of the drawbacks of setting sign posts by digging holes, other sign positioning methods have been proposed. It has been suggested that bases be constructed so that the bottom of the sign post simply rests on the surface of the ground rather than being buried. This requires some type of base. Such bases must be of a design that will maintain the sign in proper position even if exposed to disturbing influences such as wind, passersby and the like. This requires that the base be substantial in size and weight. Some bases are heavy metal such as auto wheels, while others are crossbraces which extend outwardly from the bottom of the post. Both of these expedients, however, involve considerable extra handling and storage space when not being used. Furthermore, the bases generally are not readily available and thus must be constructed or adapted by hand at considerable cost and effort. From the above discussion, it is apparent that none of the presently available sign post positioning methods are satisfactory in many situations.

The present invention provides a novel apparatus for holding a sign post in position. The sign post holding apparatus of the invention provides a simple and convenient means for positioning a sign post. The sign post holding apparatus maintains the post securely in position, while permitting the post to be removed easily when the sign is no longer needed.

The sign post holding apparatus of the present invention can be installed and removed quickly and conveniently. The installation and removal can be accomplished with a minimum of effort. In addition, use of the sign post holding apparatus eliminates the necessity for storing or removing excess soil.

The sign post holding apparatus of the invention is simple in design and relatively inexpensive to manufacture. The apparatus can be fabricated from commercially available materials. Furthermore, the apparatus can be fabricated utilizing conventional metal working techniques. Also the sign holding apparatus can be produced by semi-skilled workers.

Figure 2:
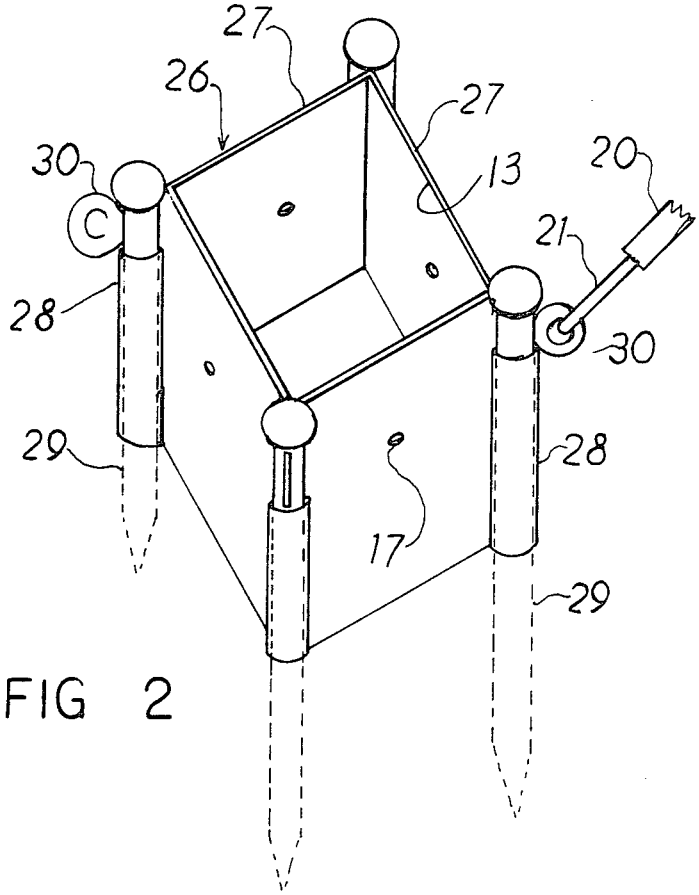

Other benefits and advantages of the novel sign post holding apparatus will be apparent from the following description and the accompanying drawings in which:

FIG. 1 is a view in perspective of one form of the sign post holding apparatus of the invention in use with a sign; and FIG. 2 is an enlarged view in perspective of the sign post holding apparatus shown in FIG. 1.

As shown in the drawings, one form of the novel sign post holding apparatus 11 of the present invention is forced into the ground 12 with a post-receiving opening 13 thereof projecting upwardly. A sign post 14 has its lower or bottom portion inserted into the opening 13 and is secured therein, advantageously with suitable fasteners such as nails 16 that extend through openings 17 in the upper part of the apparatus and into the bottom portion of the post 14. Preferably, the nails 16 may be double-headed nails for easy removal.

A crossmember 18 is affixed to the upper portion of the post 14. The crossmember 18 extends outwardly from the post 14 and a suitable sign 19 is suspended from the crossmember.

The sign advantageously is connected to the sign post holding apparatus through connecting means such as an elastic cord 20 with hooks 21 on the ends thereof. One hook 21 may engage the lower part of sign 19 such as through a suitable bracket e.g. eye 22.

The sign post holding apparatus of the invention advantageously includes a body portion 26 with a number of flat surfaces 27. Preferably, the opening 13 of the body portion 26 is substantially square.

The sign post holding apparatus 11 also includes a plurality of retaining means extending along the length of the body portion. Advantageously, the retaining means are tubes 28 which extend along the junctures of the flat surfaces 27 of the body portion 26.

A plurality of ground-engaging members 29 are associated with the retaining means. The ground-engaging members 29 extend from adjacent the post-receiving opening 13 beyond the opposite end of the body portion 26 for a significant distance into the ground. Preferably, the ground-engaging members are rods that are disposed within the tubes 28.

Advantageously, the lower ends of the ground-engaging members 29 are pointed to facilitate driving them into the ground. The upper ends of the ground-engaging members have enlarged portions 30 adjacent the ends thereof closest to the post-receiving opening 13. Preferably, the enlarged portions 30 include an eye configuration to provide a handle for removing the ground-engaging members when desired.

In the use of the sign post holding apparatus of the present invention as shown in the drawings, the body portion 26 of the apparatus is positioned on the ground in the desired location with the post-receiving opening extending upwardly. Next, a ground-engaging member 29 is positioned in each of the tubes 28 extending along the junctures of the flat surfaces 27.

The pointed ends of the ground-engaging members 29 are pressed into the ground by applying force to the upper enlarged portions of the members. This can be accomplished by simply pressing on the top of the ground-engaging members 29 with a hand or foot if the ground is not too hard or by driving the members into the ground with a hammer. The ground-engaging members 29 are in proper position when the enlarged portions 30 bear against the tops of the tubes 28.

Thereafter, the lower portion of the post 14 is inserted into the post-receiving opening 13. Nails 16 then are driven through openings 17 of the body portion 26 and into the post 14. To stabilize the sign 19, a hook 21 at one end of a cord 20 may be attached to an eye 30 at the upper end of a ground-engaging member 29 and a hook 21 at the other end of the cord attached to eye 22 on the lower edge of the sign.

When it is desired to remove the sign and post, nails 16 are removed from the openings 17 in the apparatus, the cord 20 unhooked and the bottom of the post 14 withdrawn. To remove the apparatus of the invention from the ground, the ground-engaging members 29 are withdrawn by grasping the enlarged portion 30 of each member. After the apparatus is removed, the ground may be restored to its original condition by simply tamping the ground.

The above description and the drawings show that the present invention provides a novel apparatus for holding a sign post in position. The sign post holding apparatus of the invention provides a simple and convenient means for positioning a sign post. Not only does the sign post holding apparatus maintain the sign post securely against deflection, but also the apparatus can be removed easily from the ground when the sign is no longer needed.

The sign post holding apparatus of the present invention can be installed quickly and conveniently and can be removed just as quickly and conveniently. The installation and removal can be accomplished easily with a minimum of effort and without digging any holes. Since no holes are dug there is no need to handle any dirt and so the installation and removal can be done without getting clothes or person dirty. In addition, use of the sign post holding apparatus of the invention eliminates the need for removing or storing excess dirt.

The sign post holding apparatus of the invention is simple in design and relatively inexpensive to manufacture. The apparatus can be fabricated from commercially available materials employing conventional metal-working techniques by semi-skilled workers.

It will be apparent that various modifications can be made in the particular sign post holding apparatus described in detail above and shown in the drawings within the scope of the invention. For example, the size and configuration of the components of the apparatus can be changed to meet specific requirements provided the functioning and operation of the apparatus is not adversely affected. While the apparatus of the invention ordinarily is fabricated of heavy steel tubing, with certain soil conditions and smaller size signs, it may be desirable to fabricate the apparatus of materials having less strength such as aluminum or some other material. Therefore, the scope of the invention is to be limited only by the following claims.

What is claimed is:

1. A removable sign post holding apparatus including a body portion having a post-receiving opening at the top thereof, a plurality of tubular retaining means disposed around the periphery of said body portion, said retaining means extending along the length of said body portion from a point adjacent said post-receiving opening thereof, a plurality of ground-engaging members removably and slidably engageable with said tubular retaining means and extending from adjacent said post-receiving opening of said body portion beyond the opposite end of said body portion a significant distance, whereby said body portion is secured to the ground by said members, each of said ground-engaging members having an enlarged portion adjacent the end thereof closest to said post-receiving opening.

2. A removable sign post holding apparatus according to claim 1 wherein said body portion has a number of flat surfaces.

3. A removable sign post holding apparatus according to claim 2 wherein said body portion has a substantially square opening.

4. A removable sign post holding apparatus according to claim 2 wherein said retaining means extend along the junctures of said flat surfaces.

5. A removable sign post holding apparatus according to claim 4 wherein said retaining means are tubes extending along the junctures of said flat surfaces.

6. A removable sign post holding apparatus according to claim 5 wherein said ground-engaging members are disposed in said retaining means.

7. A removable sign post holding apparatus according to claim 1 including eye portions disposed on said ground-engaging members adjacent the upper part thereof.

* * * * *